US005813774A

United States Patent [19]

Sone et al.

[11] Patent Number: 5,813,774

[45] Date of Patent: Sep. 29, 1998

[54] TICKET-PRINTING DEVICE AND RIBBON ASSEMBLY ADAPTED FOR EASY RIBBON REPLACEMENT AND MODE SETTING

[75] Inventors: Sadao Sone; Shinji Sado, both of Tokyo; Takahiro Amada, Takasaki, all of Japan

[73] Assignees: Oki Electric Industry Co., Ltd., Minato-ku; Oki Information Systems, Co., Ltd., Takasaki, both of Japan

[21] Appl. No.: 723,802

[22] Filed: Sep. 30, 1996

[30] Foreign Application Priority Data

Oct. 18, 1995 [JP] Japan ..... 7-269927

[51] Int. Cl.[6] ..... B41J 33/02

[52] U.S. Cl. ..... 400/250; 400/249

[58] Field of Search ..... 400/247, 230, 400/249, 208, 248

[56] References Cited

U.S. PATENT DOCUMENTS

| | | | |
|---|---|---|---|
| 4,944,619 | 7/1990 | Suzuki et al. | 400/224.2 |
| 4,998,834 | 3/1991 | Taylor | 400/247 |
| 5,383,733 | 1/1995 | Zinsmeyer et al. | 400/208 |
| 5,433,540 | 7/1995 | Alday | 400/250 |
| 5,695,292 | 12/1997 | Coote | 400/250 |

*Primary Examiner*—Edgar S. Burr
*Assistant Examiner*—Dave A. Ghatt
*Attorney, Agent, or Firm*—Spencer & Frank

[57] ABSTRACT

A ticket-printing device has a ribbon sensor and a mode-switching circuit. The mode-switching circuit automatically selects different printing conditions depending on whether or not the ribbon sensor detects the presence of an ink ribbon. The ink ribbon is wound on a supply spool and take-up spool. When the ink ribbon is replaced, a ribbon fixture holds the supply spool and take-up spool in correct relative positions so that they can be easily slipped onto a supply spool shaft and take-up spool shaft in the ticket-printing device.

14 Claims, 7 Drawing Sheets

TICKET-PRINTING DEVICE AND RIBBON ASSEMBLY ADAPTED FOR EASY RIBBON REPLACEMENT AND MODE SETTING

BACKGROUND OF THE INVENTION

The present invention relates to a ticket-printing device and its replaceable ink ribbon.

Ticket printing devices are used to print airplane tickets and boarding passes, for example. A common ticket printing device of the conventional type has a thermal printing head and can print either with or without an ink ribbon. When an ink ribbon is used, heating elements in the printing head heat and melt or vaporize the ink in the ribbon, which is thereby transferred to the ticket paper. This mode of printing will be referred to below as the ribbon printing mode. When an ink ribbon is not used, the heating elements directly heat the ticket paper, the surface of which is coated with a thermosensitive colorant substance. When heated, the colorant substance changes from, for example, white to another color. This mode of printing will be referred to below as the direct printing mode, and the paper employed in the direct printing mode will be referred to as thermal paper.

One problem that occurs in the conventional ticket printing device is that the two printing modes have different optimum heating conditions, so if the ticket printing device is set for the optimum conditions in the ribbon printing mode, it will not print well in the direct printing mode, and vice versa. The settings can be made adjustable to permit optimum printing in either mode, but this means that the operator must re-adjust the device whenever the mode is changed, and leads to less-than-optimum printing due to forgotten or incorrectly performed adjustments. Alternatively, the device can operate at a fixed middle setting between the optimum conditions for the ribbon mode and direct modes, but while this middle setting avoids extremely bad printing results in both modes, it does not produce very good results in either mode.

A second problem is that the ink ribbon is difficult to replace. The ribbon is wound on two spools. Replacing the ribbon involves holding one spool in each hand, fitting both spools onto their spool shafts, and simultaneously threading the ribbon through narrow spaces between the thermal head, a platen, and various guide rollers. The task is made more difficult by the thin ribbon fabric that is usually employed. A thin fabric allows a long ribbon to be stored in a small space, thereby reducing the size of the ticket printing device or the frequency of ribbon replacement, or both, but the ribbon itself becomes weak, and is easily torn during the replacement process. Ribbon replacement thus becomes an exasperating job.

SUMMARY OF THE INVENTION

It is accordingly an object of the present invention to simplify the replacement of an ink ribbon in a ticket-printing device.

Another object of the invention is to assure correct installation of the ink ribbon.

Still another object is to assure optimum printing in both the ribbon printing mode and the direct printing mode.

The invention provides both a ticket-printing device and a ribbon replacement assembly. The ribbon replacement assembly comprises an ink ribbon, a supply spool, a take-up spool, and a ribbon fixture. One end of the ink ribbon is attached to the take-up spool; the rest of the ink ribbon is wound on the supply spool. The supply spool and take-up spool are releasably held in the ribbon fixture in relative positions matching the positions of a supply spool shaft and take-up spool shaft in the ticket-printing device.

During ribbon replacement, the supply spool and take-up spool are slipped onto the supply spool shaft and take-up spool shaft, respectively, while being held in the ribbon fixture. The supply spool and take-up spool are then released from the ribbon fixture, and the ribbon fixture is withdrawn, leaving the supply spool, take-up spool, and ink ribbon installed in the ticket-printing device.

The ticket-printing device has a printing head for printing information on ticket paper, a driver for supplying electrical energy to the printing head, a ribbon sensor for sensing the presence of the ink ribbon, and a mode-switching circuit. When the ribbon sensor detects that the ink ribbon is present, the mode-switching circuit causes the driver to supply electrical energy under electrical conditions suitable for printing with an ink ribbon. When the ribbon sensor detects that the ink ribbon is not present, the mode-switching circuit causes the driver to supply electrical energy under different electrical conditions, suitable for printing without an ink ribbon.

DETAILED DESCRIPTION OF THE INVENTION

An embodiment of the invention will be described with reference to the attached illustrative drawings. The ribbon replacement assembly will be described first, and the ticket printing device second; then the operations of replacing an ink ribbon and setting the printing mode will be described.

Figure 1:
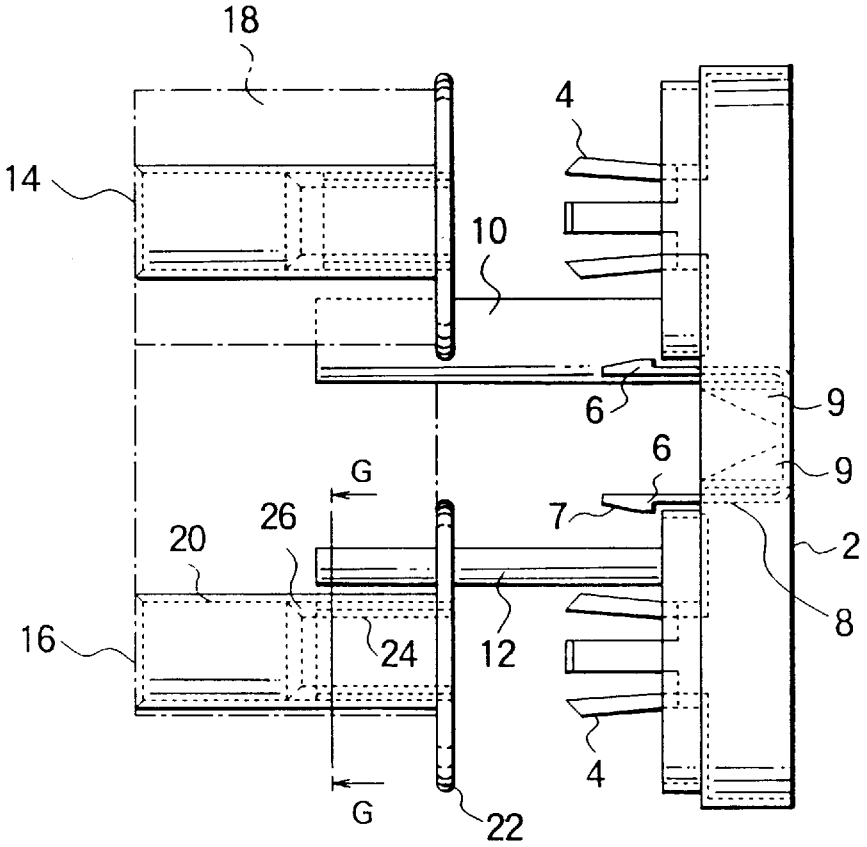
FIG. 1 is a plan view of the ink ribbon and ribbon fixture.

Referring to FIG. 1, the ribbon replacement assembly comprises a ribbon fixture 2 having two groups of projecting tongues 4, and a pair of flexible members 6 with projecting tips 7. The tongues 4 are disposed in two ring-shaped groups, with four tongues in each group. The tongues 4 have beveled ends and are bent slightly outward. The two flexible members 6 are positioned so that their projecting tips 7 face toward these two groups. Disposed near the bases 8 of the flexible members 6 are a pair of stoppers 9 for limiting the flexure of the flexible members 6. The ribbon fixture 2 also has two projecting guides 10 and 12. The ribbon fixture 2 and its projecting tongues 4, flexible members 6, stoppers 9, and guides 10 and 12 are formed as a unitary structure of, for example, molded acrylonitrile-butadiene-styrene (ABS) or some other plastic material.

The ribbon replacement assembly also comprises a supply spool 14 and take-up spool 16, shown detached from the ribbon fixture 2 in FIG. 1. The ink ribbon 18, indicated by dash-dot lines in the drawings, is wound on the supply spool 14, with its free end attached to the take-up spool 16. When the supply spool 14 and take-up spool 16 are held in the ribbon fixture 2, the ink ribbon 18 passes beneath the guides 10 and 12.

The take-up spool 16 has a hollow cylindrical core 20 with a flange 22 at one end. Disposed within the core 20 at the same end as the flange 22 is an inner grooved ring 24, which is attached to the core 20 by an annular projection 26 located near the middle of the core 20. The supply spool 14 has the same structure as the take-up spool 16, with a flange, inner grooved ring, and annular projection.

Figure 2:
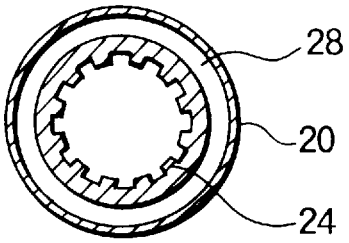
FIG. 2 is a sectional view through line G—G in FIG. 1.

FIG. 2 is a sectional view through line G—G in FIG. 1, showing the inner grooved ring 24 in more detail. The grooves of the inner grooved ring 24 face inward. The space between the inner grooved ring 24 and core 20 forms a circular channel 28.

Figure 3:
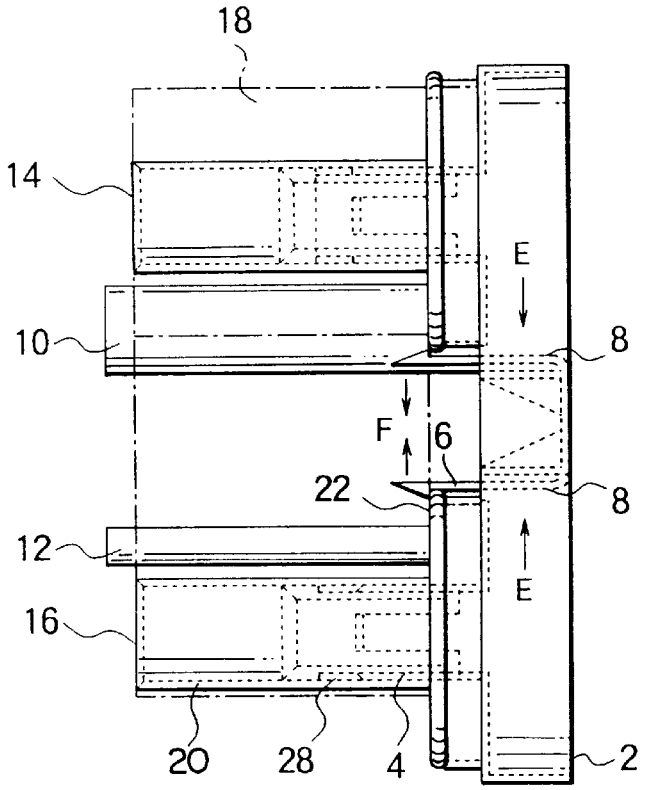
FIG. 3 is another plan view, showing the ink ribbon held in the ribbon fixture.

FIG. 3 shows the supply spool 14 and take-up spool 16 attached to the ribbon fixture 2 in a condition suitable for storage, and ready for installation in the ticket printing device. In each spool, the tongues 4 fit into the circular channel 28 and press outward against the core 20. The projecting tips 7 of the flexible members 6 fit over and restrain the rims of the flanges 22, thus preventing the spools from being separated from the ribbon fixture.

Figure 4:
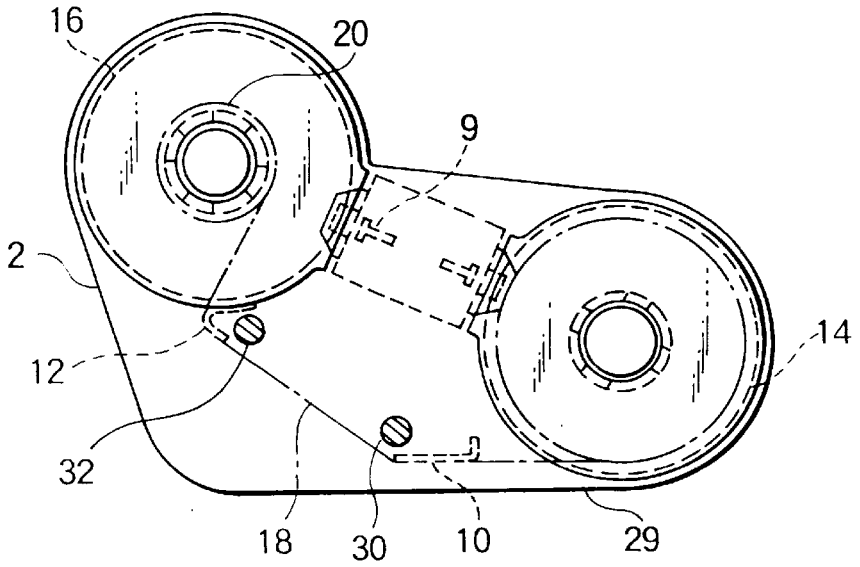
FIG. 4 is a side view showing the ink ribbon held in the ribbon fixture.

Referring to the side view in FIG. 4, the ribbon fixture 2 has a level base 29, but holds the supply spool 14 and take-up spool 16 at different heights above the base 29. The guides 10 and 12 position the ink ribbon 18 so that it passes around two guide rollers 30 and 32 disposed in the ticket printing device. The guide rollers 30 and 32 are not part of the ribbon fixture 2, but are shown here to illustrate their positional relationship to the guides 10 and 12. FIG. 4 also shows the shape of the stoppers 9.

Figure 5:
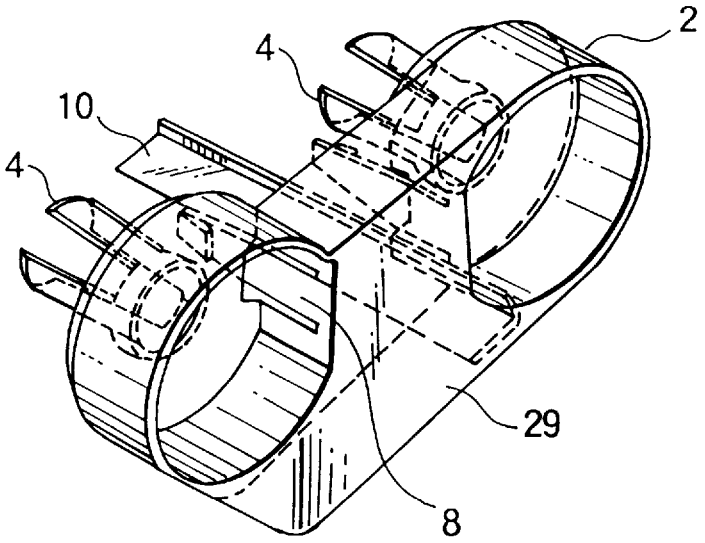
FIG. 5 is a perspective view of the ribbon fixture.

FIG. 5 shows the ribbon fixture 2 by itself, as seen at an angle from above the base 29, illustrating the shape of the tongues 4 and guide 10, and showing how the bases 8 of the flexible members are attached to the ribbon fixture 2. The stoppers 9 and guide 12 are omitted for clarity.

Figure 6:
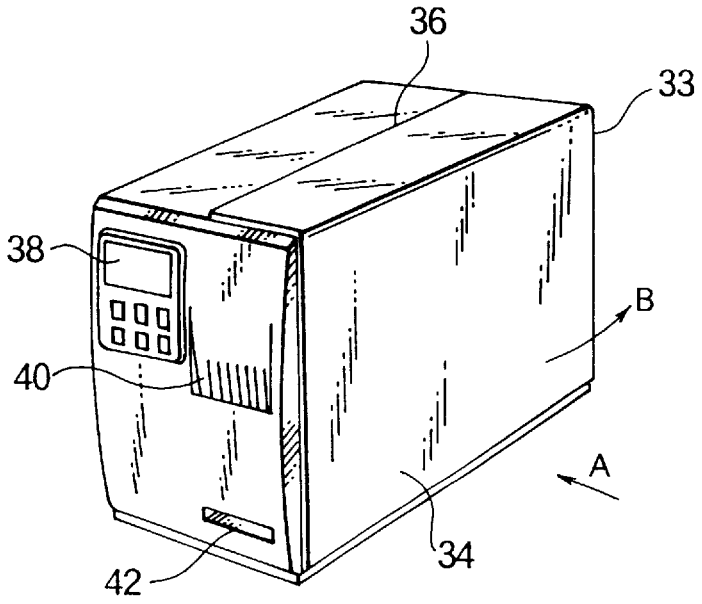
FIG. 6 is an exterior perspective view of the ticket printing device.

FIG. 6 shows an exterior view of the ticket-printing device 33 in which the ink ribbon 18 will be installed. Arrow A indicates the direction from which the ink ribbon 18 is installed. The ticket-printing device 33 has a side cover 34 that swings open from a hinge 36 at the center of the top of the device. The front cover of the ticket-printing device has a control panel 38 with control buttons and a liquid crystal display, a dispensing slot 40 from which tickets are dispensed, and an insertion slot 42 where tickets can be inserted for processing.

Figure 7:
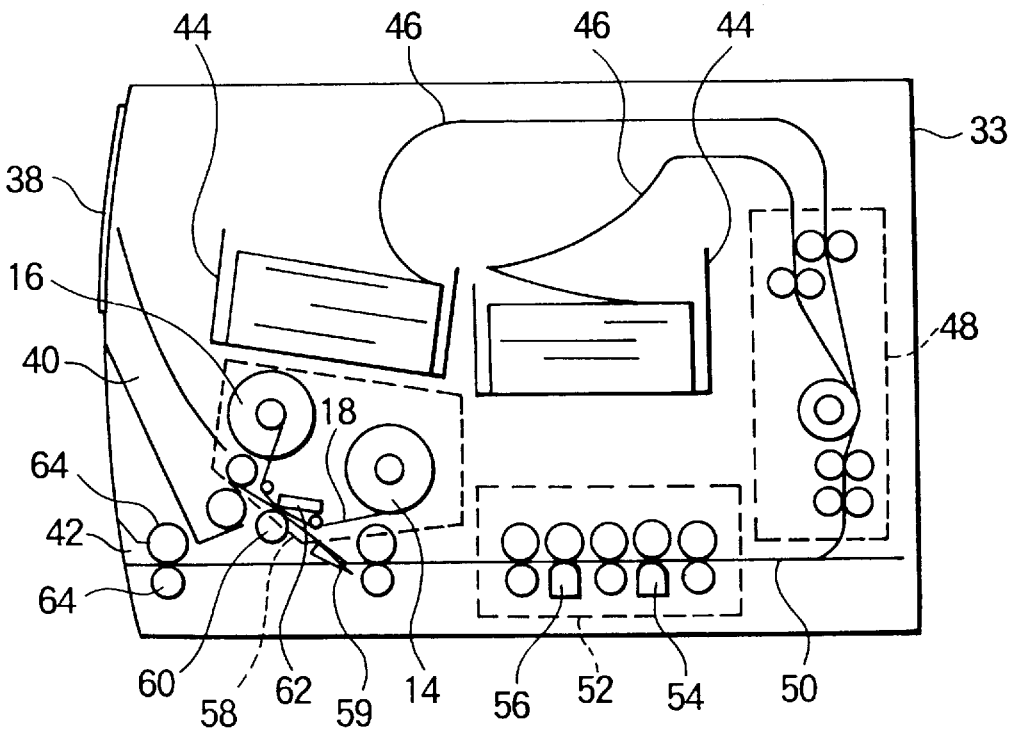
FIG. 7 is a lateral sectional view of the ticket printing device.

Referring to FIG. 7, inside the ticket-printing device 33 are two hoppers 44 containing fan-folded ticket paper 46. Both hoppers 44 may contain the same type of ticket paper 46, or they may contain different types. The ticket paper 46 in each hopper 44 comprises a continuous strip with perforations between each two adjacent tickets in the strip. The ticket paper 46 from both hoppers 44 is fed into a cutter 48, which cuts one ticket from the appropriate strip of ticket paper 46 in response to a ticket-issuing command, and delivers the cut ticket to a ticket transport path 50.

Disposed on this ticket transport path 50 is a magnetic read-write unit 52 comprising a magnetic writing head 54 and a magnetic reading head 56. The magnetic writing head 54 records invisible information in a magnetic stripe on the back surface of the ticket. The magnetic reading head 56 reads the recorded information.

From the magnetic read-write unit 52, the ticket passes to a printing unit 58 comprising a blade 59, a platen 60, a thermal printing head 62, and the ink ribbon 18 on its supply spool 14 and take-up spool 16. The blade 59 guides the ticket between the platen 60 and thermal printing head 62. The ticket and ink ribbon 18 pass together between the platen 60 and thermal printing head 62. By pressing the ticket and ink ribbon 18 against the platen 60, and selectively heating the ink ribbon 18, the thermal printing head 62 prints visible information on the front surface of the ticket. The printed ticket is then ejected through the dispensing slot 40.

The ink ribbon 18 is used for printing on ordinary ticket paper. If the hoppers 44 contain thermal ticket paper, the supply spool 14, take-up spool 16, and ink ribbon 18 are removed from the ticket-printing device 33 so that the thermal printing head 62 can print on the ticket paper in the direct printing mode.

When a ticket (an airplane reservation ticket, for example) is inserted in the insertion slot 42, the ticket is carried by intake rollers 64 past the blade 59, the invisible magnetic information on the ticket is read by the magnetic reading head 56, and additional magnetic information is written, if necessary, by the magnetic writing head 54. Then the ticket is fed forward into the printing unit 58, additional visible information is printed if necessary, and the ticket is ejected through the dispensing slot 40.

Figure 8:
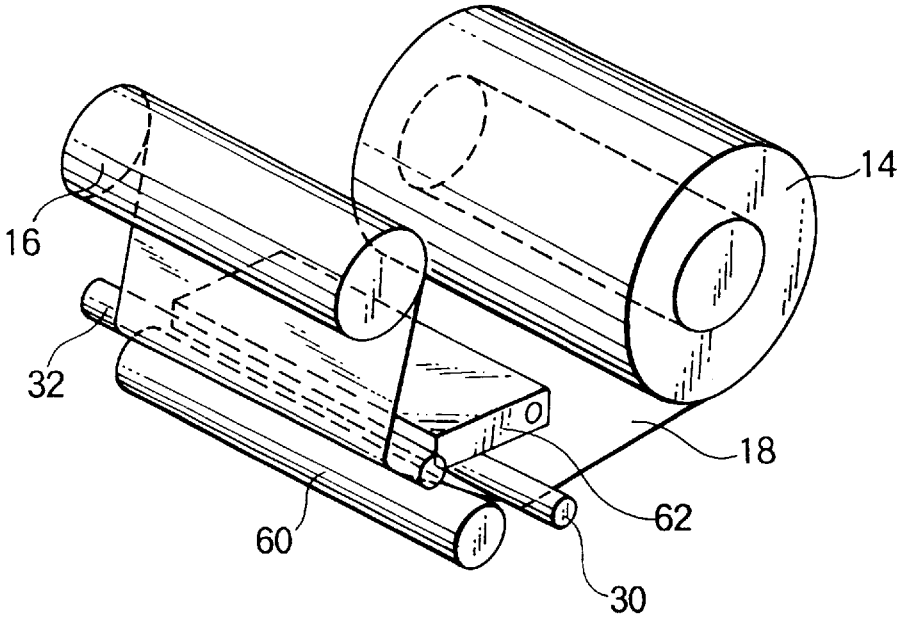
FIG. 8 is a perspective view of the printing unit in the ticket printing device.

FIG. 8 is an enlarged view of the printing unit 58, showing how the ink ribbon 18 is fed between the platen 60 and thermal printing head 62. The ink ribbon 18 is guided by the guide rollers 30 and 32, the guide roller 30 being disposed on the side near the supply spool 14, and the guide roller 32 on the side near the take-up spool 16.

Figure 9:
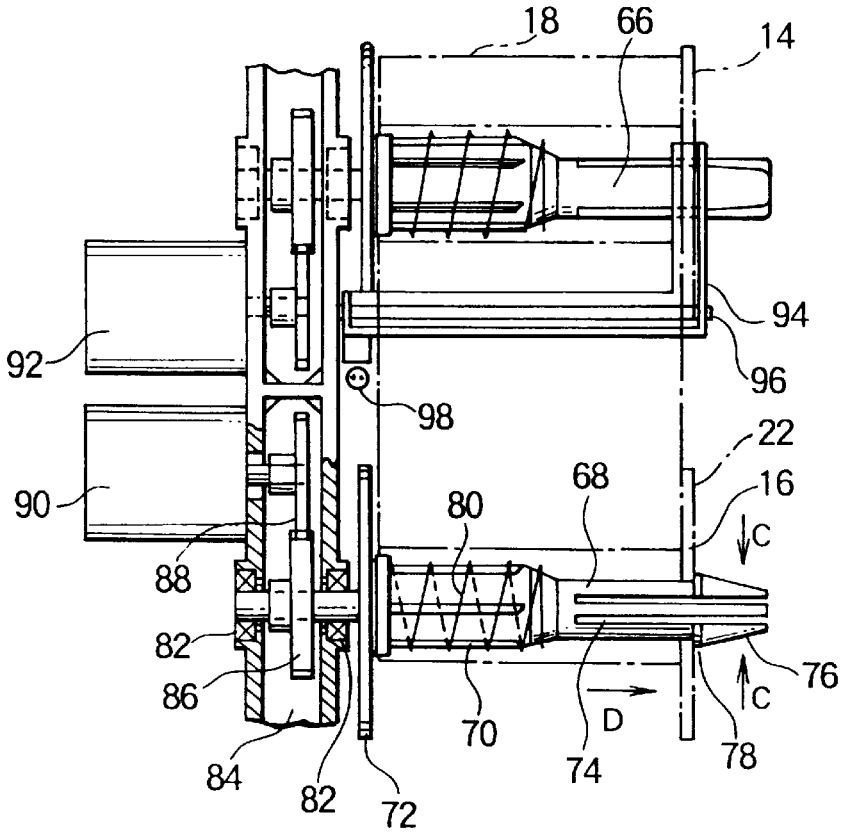
FIG. 9 is a plan view of the ribbon winding mechanism in the printing unit.

FIG. 9 shows the mechanism in the printing unit 58 for turning the supply spool 14 and take-up spool 16. The supply spool 14 is mounted on a supply spool shaft 66, and the take-up spool 16 on a take-up spool shaft 68. The distance between the supply spool shaft 66 and take-up spool shaft 68 matches the distance between the cores 20 of the supply spool 14 and take-up spool 16 when held in the ribbon fixture 2.

The supply spool shaft 66 and take-up spool shaft 68 are mutually similar in structure, each having a large-diameter portion with longitudinal projections 70 and a flange 72, and a narrow-diameter hollow portion with grooves 74. The narrow-diameter portion of the spool shaft has a tapered end 76 with a ridge 78 that projects over the flange 22 of the spool 14 or 16, and prevents the spool 14 or 16 from escaping in the direction of arrow D. A coil spring 80 is wound around the large-diameter portion of the spool shaft, and pushes the spool in the direction of arrow D.

The take-up spool shaft 68 extends beyond the flange 72, is supported on bearings 82 in a frame 84 of the printing unit, and is attached to a ribbon gear 86. The ribbon gear 86 engages a motor gear 88 attached to a first stepping motor 90, which thus turns the take-up spool shaft 68. The supply spool shaft 66 is similarly turned by a second stepping motor 92. The longitudinal projections 70 on each spool shaft press against the inside surface of the core 20 of the corresponding spool, and the grooves 74 engage the inner grooved ring 24 attached to the inside of the core 20, so that the spool is compelled to turn with the spool shaft.

Figure 10:
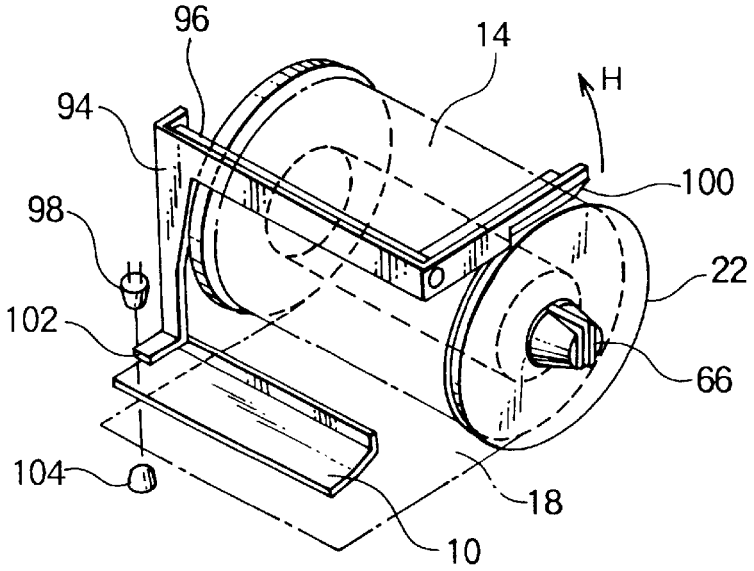
FIG. 10 is a perspective view illustrating the ribbon sensor in the printing unit.

A lever 94 is mounted on a lever shaft 96 near the supply spool 14. The position of the lever 94 is detected by a ribbon sensor 98, which is in this embodiment a photosensor. FIG. 10 shows the sensor arrangement in more detail. The lever 94 has a beveled edge 100 at one end. When the supply spool 14 is mounted on the supply spool shaft 66, the rim of the flange 22 of the supply spool 14 pushes against this beveled edge, causing the lever 94 to turn in the direction of arrow H, so that the flange 22 can slip under the beveled edge 100. The inside part of the lever 94, disposed just behind the beveled edge 100, then rests against the rim of the flange 22. In this position, the bent tip 102 at the other end of the lever 94 is drawn away from the ribbon sensor 98, permitting light from a light source 104 to reach the ribbon sensor 98.

When the ink ribbon 18 is not installed, gravity causes the lever 94 to swing in the direction opposite to arrow H, so that the bent end 102 of the lever 94 blocks the light path between the light source 104 and ribbon sensor 98.

Figure 11:
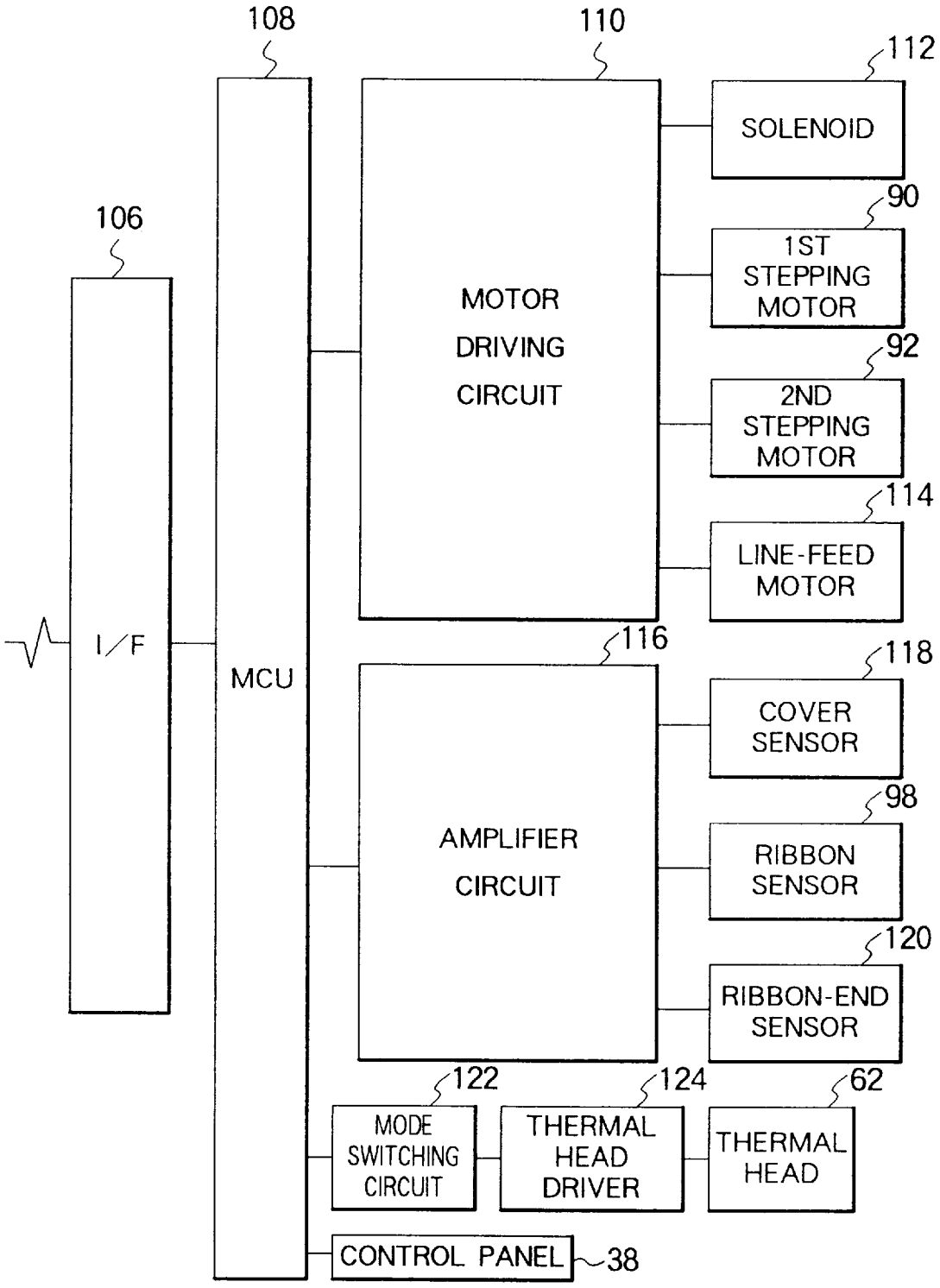
FIG. 11 is a block diagram of the control system of the printing unit.

FIG. 11 illustrates the control system of the printing unit. This control system communicates via an interface unit (I/F) 106 with a higher-level controller (not visible), which supplies the information to be printed on the ticket. This information is processed by a microcontroller unit (MCU) 108, which controls a motor driving circuit 110. This motor driving circuit 110 supplies exciting current to a solenoid 112 that presses the thermal head 62 against the platen roller 60, to the stepping motors 90 and 92 that turn the spool shafts 66 and 68, and to a line-feed motor 114 that turns the platen roller 60.

The microcontroller unit 108 receives signals via an amplifier circuit 116 from the ribbon sensor 98, and from a cover sensor 118 and a ribbon-end sensor 120, which were not shown in the previous drawings. The cover sensor 118 senses whether the side cover 34 of the ticket-printing device is open or closed. The ribbon-end sensor 120 senses when the end of the ink ribbon 18 has been reached. The amplifier circuit 116 amplifies the outputs of these sensors 98, 118, and 120 to levels suitable for input to the microcontroller unit 108.

The microcontroller unit 108 is also coupled to the control panel 38, and to a mode switching circuit 122. The mode switching circuit 122 controls a thermal head driver 124 that supplies energy in the form of electrical current pulses to the thermal printing head 62.

The thermal head driver 124 is adapted to operate according to at least two different sets of electrical conditions. The electrical conditions in question concern the duration and shape of the electrical current pulses supplied to the thermal printing head 62; these conditions determine the amount and intensity of the heat delivered by the thermal printing head 62 to the ink ribbon 18 or ticket paper 46.

The mode switching circuit 122 causes the thermal head driver 124 to operate in two modes: a ribbon printing mode in which electrical conditions optimized for use with the ink ribbon 18 are employed; and a direct printing mode in which electrical conditions optimized for direct printing on thermal ticket paper are employed. The mode is selected by a command from the microcontroller unit 108.

Circuit details of the mode switching circuit 122 and thermal head driver 124 will be omitted, because circuits for delivering controlled current pulses to a thermal printing head are well known.

Next, the operation of replacing the ink ribbon 18 will be described.

First, the process of mounting the ink ribbon 18 and its supply spool 14 and take-up spool 16 in the ribbon fixture 2 will be described. This process is preferably performed by the ribbon manufacturer when the ribbon is manufactured, but can easily be carried out in the field, if necessary, by the person operating the ticket-printing device.

Referring again to FIG. 1, the process begins with the ink ribbon 18 wound entirely on the supply spool 14, except that one end is attached to the core 20 of the take-up spool 16. The first step is to unwind a certain length of ink ribbon 18 from the supply spool 14. The supply spool 14 is then mated with the upper group of four tongues 4 in FIG. 1, and pushed to the right in the drawing until the flange 22 makes contact with the body of the ribbon fixture 2. The beveled ends of the tongues 4 facilitate the insertion of the tongues 4 into the circular channel 28 shown in FIG. 2.

Next, the ink ribbon 18 is led beneath the guides 10 and 12, and the take-up spool 16 is mounted on the lower group of four tongues 4 in FIG. 1. The supply spool 14 is then turned to take up slack in the ink ribbon 18, so that the ribbon lies flat against the guides 10 and 12, as shown in FIG. 3. The outward pressure exerted by the tongues 4 on the inside surface of the cores 20 of the supply spool 14 and take-up spool 16 is sufficient to hold the ink ribbon 18 in this position, through not so strong as to prevent the supply spool 14 and take-up spool 16 from being turned by hand.

As the supply spool 14 and take-up spool 16 are pushed toward the body of the ribbon fixture 2, the edges of the flanges 22 press against the projecting tips 7 of the flexible members 6, so that the flexible members 6 are pushed inward, in the direction of the arrows F in FIG. 3. When the flanges 22 rest against the body of the ribbon fixture 2, the flexible members 6 spring back, so that the projecting tips 7 lock the flanges 22 in place. The ink ribbon 18 is now held in a state suitable for storage and transportation. The ink ribbon 18 will not unwind due to careless handling, for example, because the pressure exerted by the tongues 4 prevents the supply spool 14 and take-up spool 16 from turning freely.

Next, the process of removing an old ribbon from the ticket-printing device 33 will be described. This process is normally carried out by the operator of the ticket-printing device 33, when the ribbon-end sensor 120 senses the end of the ribbon. In this state the ribbon has been fully unwound from the supply spool 14 and taken up on the take-up spool 16.

The operator begins by opening the side cover 34 shown in FIG. 6. The supply spool 14 and take-up spool 16 are held in place by the ridges 78 on the spool shafts, as shown in FIG. 9. To remove the supply spool 14 and take-up spool 16, the operator presses inward on the tapered ends 76 of the spool shafts 66 and 68, e.g. in the direction of the arrows C in FIG. 9. This enables the supply spool 14 or take-up spool 16 to slip over the ridges 78. The coil spring 80 pushes against the annular projection 26 supporting the inner grooved ring 24 inside the spool, so that when the operator squeezes the tapered ends 76, the spool springs out to a certain distance in the direction of arrow D. After releasing both spools 14 and 16 in this way, the operator can easily withdraw the spools and the ink ribbon 18 by hand. No particular care is required, because the ink ribbon 18 is used up and will only be thrown away.

Next the process of installing the new ink ribbon 18 will be described. The new ink ribbon 18 is mounted on a ribbon fixture 2 as shown in FIGS. 3 and 4.

As can be seen by comparing FIG. 4 with FIGS. 7, 8, and 9, the ribbon fixture 2 holds the supply spool 14 and take-up spool 16 in relative positions matching the relative positions of the supply spool shaft 66 and take-up spool shaft 68, and holds the ink ribbon 18 in the correct position to be threaded under the guide rollers 30 and 32 and between the platen 60 and thermal printing head 62. Accordingly, the operator only has to hold the base 29 of the ribbon fixture 2 level, align the cores 20 of the spools 14 and 16 with the spool shafts 66 and 68, and move the entire ribbon replacement assembly as a single unit toward the printing unit 58. Precise alignment is not necessary. Because of the tapered ends 76 of the spool shafts 66 and 68, the spools 14 and 16 will slip onto the spool shafts 66 and 68 even without being precisely aligned. The operator continues to push the ribbon fixture 2 until the ridges 78 of the spool shafts snap over the inner rims of the flanges 22 of the spools 14 and 16. The spools 14 and 16 are now locked in place on the spool shafts 66 and 68.

Next the operator must remove the ribbon fixture 2. This is done by pressing inward on the bases 8 of the flexible members 6, in the direction of the arrows E in FIG. 3. The projecting tips 7 of the flexible members 6 then move inward in the direction of the arrows F, disengaging from the outer rims of the flanges 22 of the spools 14 and 16. The ribbon fixture 2 can now be withdrawn from the ticket-printing device 33.

Painstaking care is not required at any point in this procedure. The guides 10 and 12 of the ribbon fixture 2 automatically thread the ink ribbon 18 around the guide rollers 30 and 32 and between the platen 60 and thermal printing head 62. The stoppers 9 prevent the operator from breaking the flexible members 6 by pressing too hard. The ribbon fixture 2 cannot be left inadvertently inside the ticket-printing device 33 because the side cover 34 will not close until the ribbon fixture 2 is removed, and the ticket-printing device 33 will not operate unless the side cover 34 is closed. Thus the ribbon fixture 2 simplifies the ribbon replacement job and prevents mistakes, as well as preventing damage to the new ink ribbon 18.

If the ribbon is replaced while the power of the ticket printing device is switched on, a further safeguard is provided by the ribbon sensor 98. When the new ribbon is installed, the output of the ribbon sensor 98 changes from the off state to the on state as the flange 22 of the supply spool 14 pushes the beveled edge 100 of the lever 94 in the direction of arrow H in FIG. 9, withdrawing the bent end 102 of the lever 94 from the path of the light from the light source 104. If the ribbon fixture 2 is pushed sufficiently far for the ridges 78 of the spool shafts to lock the supply and take-up spools 14 and 16 in place, the tip of the projecting guide 10 of the ribbon fixture 2 blocks the light path, causing the ribbon sensor output to turn off again. When the ribbon fixture 2 is withdrawn, the ribbon sensor output turns on again and remains on. The microcontroller unit 108 can confirm that ribbon replacement has been correctly performed by detecting the off-on-off-on sequence of ribbon sensor output transitions.

If the ribbon fixture 2 is pushed insufficiently far, so that the ridges 78 of the spool shafts do not lock the spools 14 and 16 in place, the tip of the projecting guide 10 of the ribbon fixture 2 will not block the light path to the ribbon sensor 98, and only a single off-on transition of the ribbon sensor output will be detected. The microcontroller unit 108 can then display a warning message on the control panel 38 when the side cover 34 is closed, advising the operator that the ribbon is not fully installed, thereby avoiding possible printing problems due to wrinkling of the ink ribbon 18, or failure of the ink ribbon 18 to be properly wound up on the take-up spool 16.

Next the process of setting the printing mode will be described. This process is carried out automatically, without requiring the operator to remember to make any adjustments, as part of an overall control process executed by the control system in FIG. 11.

Figure 12:
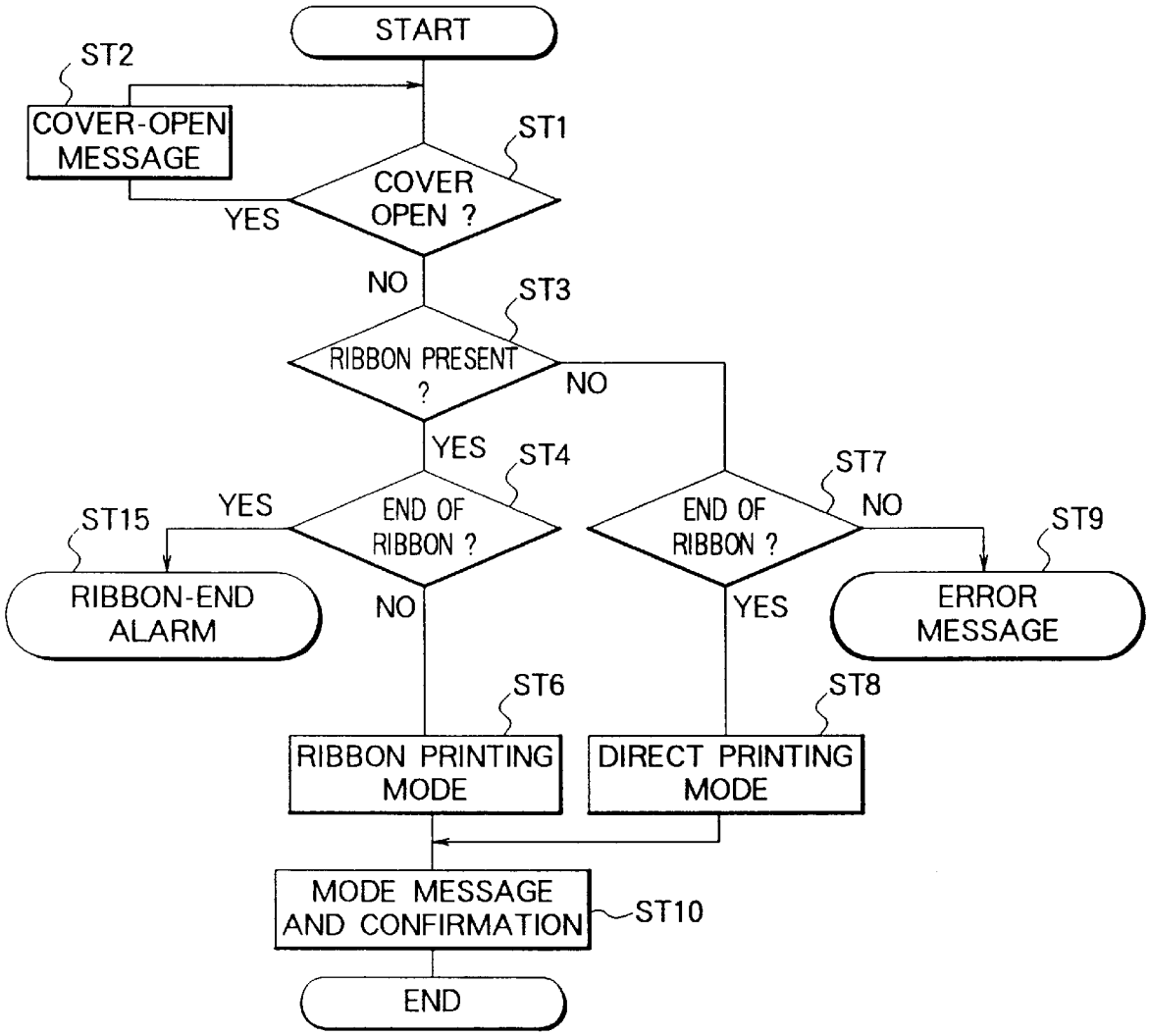
FIG. 12 is a flowchart illustrating the operation of the control system in FIG. 11.

FIG. 12 exhibits the relevant part of the control process in the form of a flowchart. The process in FIG. 12 is carried out as part of a reset routine at power up, and is also executed in response to a change in sensor input, e.g. when the side cover 34 is opened or closed.

In the first step (ST1), the cover sensor 118 is checked. If the side cover 34 is open, a message to this effect is displayed (step ST2). Display of this cover-open message continues until the side cover 34 is closed.

Next, the ribbon sensor 98 is checked. If the ribbon sensor 98 indicates that an ink ribbon 18 is installed, a branch is made to step ST4, in which the ribbon-end sensor 120 is checked. If the ribbon-end sensor 120 indicates that the end of the ink ribbon 18 has been reached, a ribbon-end alarm is activated (step ST5). The ribbon-end alarm is, for example, a visible or audible alarm accompanied by a message advising the operator to replace the ribbon. If the ribbon-end sensor 120 does not indicate the end of the ink ribbon 18, the mode switching circuit 122 is set to the ribbon printing mode (step ST6).

If the ribbon sensor 98 does not indicate that an ink ribbon 18 is installed in step ST3, a transition is made to step ST7, in which the ribbon-end sensor 120 is likewise checked. Since no ribbon is installed, the ribbon-end sensor 120 will normally indicate the end of the ribbon, in which case the mode switching circuit 122 is set to the direct printing mode (step ST8). If the ribbon-end sensor 120 does not indicate the end of the ribbon, an error message is displayed (step ST9), advising the operator to check the sensors for a possible electrical fault or the presence of a foreign object.

After the ribbon printing mode or direct printing mode has been set in step ST6 or step ST8, the mode setting is displayed on the control panel 38 and the operator is asked to confirm the mode setting. If the operator presses a confirmation button, the mode setting is accepted, the setting procedure ends, and the ticket-printing device is ready to print. If the operator does not confirm the mode setting, printing is deferred until the operator takes further action, such as installing or removing an ink ribbon 18 or changing the ticket paper. After such action, the entire procedure from step ST1 is performed again.

Once the printing mode has been set, the ticket-printing device 33 continues to operate in the selected mode until power is switched off, or a reset button is pressed, or the side cover 34 is opened, or the end of the ink ribbon 18 is detected.

Since the mode is set automatically, and the operator is only called on to confirm the mode setting, printing problems due to forgotten or incorrectly performed mode adjustments are eliminated. Optimum printing is obtained in both the ribbon printing mode and direct printing mode, without the need for any particular care on the operator's part, and ticket legibility is improved, as compared with ticket-printing devices that print with the same electrical conditions in both modes.

The invention is not restricted to the embodiment described above; the structure of both the ticket printing device and the replacement ribbon assembly can be modified in various ways. To give just one example, the ribbon fixture 2 does not have to be made of molded plastic; other materials may be used, including both disposable or recyclable materials such as stiff cardboard, and durable materials that enable the ribbon fixture to be used repeatedly.

Those skilled in the art will recognize numerous further variations that are possible within the scope of the invention as claimed below.

What is claimed is:

1. A ribbon replacement assembly in combination with a ticket-printing device, said ribbon replacement assembly having an ink ribbon wound on a supply spool for installation on a supply spool shaft in said ticket-printing device, and a take-up spool for installation on a take-up spool shaft in said ticket-printing device, one end of said ink ribbon being attached to said take-up spool, said supply spool and said take-up spool having respective flanges, comprising:

ribbon fixture means for releasably holding said supply spool and said take-up spool in relative positions matching relative positions of said supply spool shaft and said take-up spool shaft, so that said supply spool and said take-up spool can be slipped onto said supply spool shaft and said take-up spool shaft while held in said ribbon fixture means, then released from said ribbon fixture means, allowing said ribbon fixture means to be withdrawn from said ticket-printing device while leaving said supply spool, said take-up spool, and said ink ribbon installed in said ticket-printing device, wherein said ribbon fixture means includes a pair of flexible members with projecting tips for restraining said flanges of said supply spool and said take-up spool, said flexible members being disposed between said supply spool and said take-up spool, said supply spool and said take-up spool being released from said ribbon fixture means by inward pressure on said flexible members, causing said projecting tips to disengage from said flanges.

2. A ribbon replacement assembly in combination with a ticket-printing device as claimed in claim 1, wherein said ribbon fixture means also holds said supply spool and said take-up spool while said supply spool, said take-up spool, and said ink ribbon are being stored prior to installation in said ticket-printing device.

3. A ribbon replacement assembly in combination with a ticket-printing device as claimed in claim 1, wherein said ticket-printing device has a ribbon sensor for detecting whether said ink ribbon is present, and when said ink ribbon is correctly installed while being held in said ribbon fixture means, said ribbon sensor detects a part of said ribbon fixture means, thereby confirming correct installation of said ink ribbon.

4. A ribbon replacement assembly in combination with a ticket-printing device as claimed in claim 1, wherein:

said supply spool and said take-up spool have respective circular channels with inside surfaces; and said ribbon fixture means has a plurality of tongues which are inserted into the circular channels of said supply spool and said take-up spool when said supply spool and said take-up spool are held in said ribbon fixture means, for pressing outward against the inside surfaces of said circular channels, thereby preventing said supply spool and said take-up spool from turning freely.

5. A ribbon replacement assembly in combination with a ticket-printing device as claimed in claim 1, also comprising at least one guide means attached to said ribbon fixture means, for guiding said ink ribbon so that said ink ribbon follows a certain path from said supply spool to said take-up spool.

6. A ribbon replacement assembly in combination with a ticket-printing device as claimed in claim 5, wherein said ticket-printing device has a ribbon sensor for detecting whether said ink ribbon is present, and when said ink ribbon is correctly installed while being held in said ribbon fixture means, said ribbon sensor detects a part of said at least one guide means, thereby confirming correct installation of said ink ribbon.

7. A ribbon replacement assembly in combination with a ticket-printing device as claimed in claim 5, wherein said ticket-printing device has a printing head and a platen, and said at least one guide means guides said ink ribbon between said printing head and said platen when said ink ribbon is being installed in said ticket-printing device.

8. A ribbon replacement assembly for use with a printing device having first and second shafts, comprising:

a supply spool having a flange;

a take-up spool having a flange;

a ribbon wound on the supply spool, the ribbon having an end that is attached to the take-up spool; and ribbon fixture means for releasably holding the supply spool and the take-up spool at relative positions matching the relative positions of the first and second shafts of the printing device, so that the supply spool can be slipped onto the first shaft and the take-up spool can be slipped onto the second shaft while the spools are held in the ribbon fixture means and so that the spools can then be released from the ribbon fixture means, allowing the ribbon fixture means to be withdrawn from the printing device while leaving the spools and ribbon installed in the printing device, wherein the ribbon fixture means includes a pair of flexible members with projecting tips for engaging the flanges of the spools to latch the spools to the ribbon fixture means, the flexible members being disposed between the spools, the spools being released from the ribbon fixture means by manual deflection of the flexible members toward one another, causing the projecting tips to disengage from the flanges of the spools.

9. The ribbon replacement assembly of claim 8, wherein the ribbon fixture means additionally includes a group of projecting tongues that are inserted into a cavity in the supply spool and frictionally engage the supply spool, and another group of projecting tongues that are inserted into a cavity in the take-up spool and that frictionally engage the take-up spool.

10. The ribbon replacement assembly of claim 9, wherein the projecting tongues have outer ends that are beveled.

11. The ribbon replacement assembly of claim 9, wherein the ribbon fixture means additionally includes at least one guide member means for supporting a section of the ribbon between the spools so that the section of ribbon between the spools follows a predetermined crooked path.

12. The ribbon replacement assembly of claim 11, wherein the at least one guide member means, the groups of projecting tongues, and the flexible members are parts of a unitary plastic element.

13. The ribbon replacement assembly of claim 8, wherein the ribbon fixture means additionally includes at least one projection which extends into a cavity in the supply spool, at least one projection which extends into a cavity in the take-up spool, and at least one guide member means for supporting a section of the ribbon between the spools so that the section of ribbon between the spools follows a predetermined crooked path, and wherein the flexible members, the projections, and the at least one guide member means are parts of a unitary plastic element.

14. The ribbon replacement assembly of claim 13, wherein the plastic is ABS.

* * * * *